United States Patent [19]

Geyer

[11] Patent Number: 4,830,113

[45] Date of Patent: May 16, 1989

[54] WELL PUMPING METHOD AND APPARATUS

[75] Inventor: Nelson I. Geyer, Norman, Okla.

[73] Assignee: Skinny Lift, Inc., Norman, Okla.

[21] Appl. No.: 123,301

[22] Filed: Nov. 20, 1987

[51] Int. Cl.[4] ..... E21B 19/22; E21B 43/00

[52] U.S. Cl. ..... 166/369; 166/66.4; 166/68; 166/380; 166/385

[58] Field of Search ..... 166/66.4, 65.1, 53, 166/369, 381, 384, 385, 68, 77, 105, 242, 250; 417/422, 410

[56] References Cited

U.S. PATENT DOCUMENTS

| | | | |
|---|---|---|---|
| 2,297,020 | 9/1942 | Page | 166/66.4 |
| 3,285,629 | 11/1966 | Cullen et al. | 166/65.1 X |
| 3,835,929 | 9/1974 | Suman, Jr. | 166/66.4 X |
| 4,476,923 | 10/1984 | Walling | 166/66.4 |
| 4,570,705 | 2/1986 | Walling | 166/77 |
| 4,681,169 | 7/1987 | Brookbank, III | 166/77 X |
| 4,715,443 | 12/1987 | Gidley | 166/77 X |

*Primary Examiner*—Stephen J. Novosad

*Attorney, Agent, or Firm*—Nixon & Vanderhye

[57] ABSTRACT

A well pumping method and apparatus whereby fluids such as water or oil are pumped out of a well casing in an annular space between an electrical power cable and an associated protective metal coil tubing which surrounds the cable. To this end, the downhole end of the tubing is connected to the outlet of a submersible motor and pump assembly. In carrying out the invention, a process is practiced which includes:

(a) providing hollow, flexible tubing having a length approximating the depth of the well;

(b) inserting an electrical cable within said tubing, said cable and tubing sized to create a substantially annular space between said wire and said tubing;

(c) attaching said electrical wire and said tubing to a submersible motor and pump assembly;

(d) lowering said pump and motor assembly into said well casing; and (e) pumping said fluid out of the well casing in the annular space between the electrical cable and flexible tubing.

29 Claims, 2 Drawing Sheets

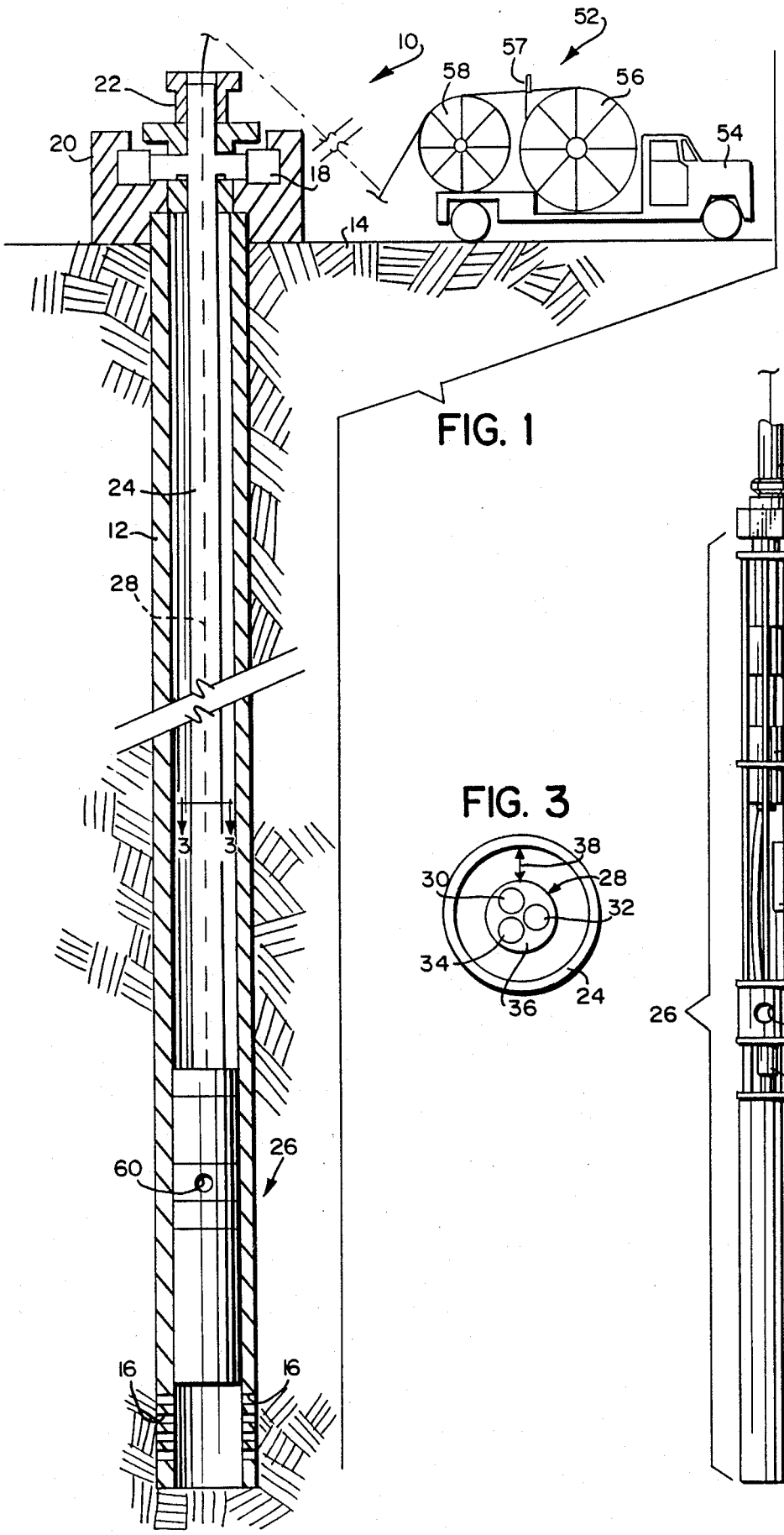
FIG. 1
FIG. 3
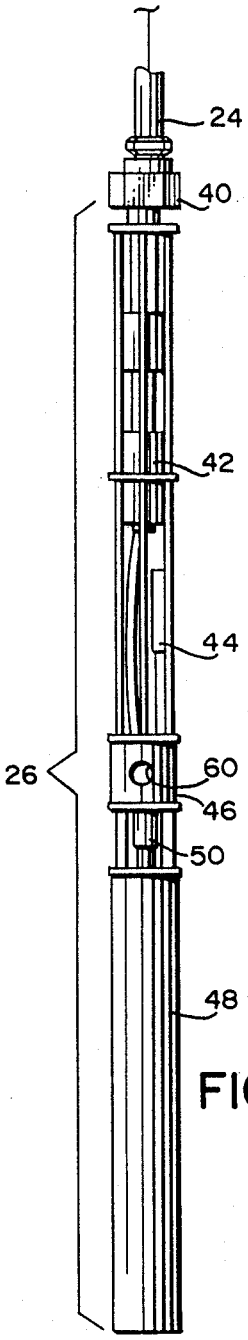
FIG. 2

WELL PUMPING METHOD AND APPARATUS

BACKGROUND AND SUMMARY OF THE INVENTION

The present invention relates to a unique well pumping system which is simple in construction, less costly, and more efficient than well pumping systems typically used in the prior art.

Conventional well pumping systems utilizing submersible pump devices typically include an above ground pumping unit, downhole tubing, a sucker rod string or a relatively large diameter centrifugal pump, usually 25 to 300 HP, and a relatively large electric or other motor to drive the pump. Systems of this type are fairly common, and not only are they difficult and expensive to install and service, but pump efficiencies are in the relatively low 30% to 50% range.

The present invention provides a process and apparatus which overcome many disadvantages of the prior art systems.

The well pumping system of this invention includes a submersible pump and motor assembly suspended within a well casing from the wellhead. This is accomplished with the aid of a flexible, hollow tube, preferably in the form of 1.25" O.D. conventional metal coil tubing attached at its upper end to the wellhead and at its downhole end to pump and motor assembly. Within, and shielded by, the metal coil tubing is an electrical power cable providing power to the pump and motor assembly. The arrangement is such that the pump and motor assembly is suspended by the coil tubing, not the power cable, and thus is easily lowered into, and lifted out of the well casing with no stress on the power cable itself.

In accordance with this invention, fluid such as water or oil, is pumped out of the well within a substantially annular space between the metal coil tubing and the power cable.

This invention thus eliminates a number of prior art components, such as the above ground pumping unit, downhole tubing, sucker rod string, downhole conventional pump, polish rod, and stuffing box.

All of the prior art components have been replaced by a flexible string of conventional metal coil tubing; a string of two or three wire braided cable, preferably clad with a suitable plastic such as polypropylene; a relatively small (about 1 to 10 HP) motor; and a relatively small (2.75 inch diameter) gear or piston pump.

Because of the elimination of several of the heavier, more cumbersome components of the prior art, and particularly the sucker rod string, smaller motors and pumps may be used at higher efficiencies up to 95%.

The present invention has the following additional advantages:

(1) service life of pump is increased;
(2) reduced repair and maintenance costs;
(3) reduced installation time and cost;
(4) ability to locate pump and motor assemblies in crooked or curved well casings;
(5) better performance in gas locking environments;
(6) fewer safety related hazards;
(7) more attractive appearance at the ground level by reason of a significantly smaller wellhead;
(8) ability to monitor downhole fluid levels and associated means to shut down system when fluid levels are low.

In a related aspect, a process of installing a well pumping system is provided, which includes the steps of:

(a) providing hollow, flexible tubing having length approximately the depth of the well;
(b) inserting an electrical cable within said tubing, said cable and tubing sized to create a substantially annular space between said wire and said tubing;
(c) attaching said electrical wire and said tubing to a submersible motor and pump assembly;
(d) lowering said pump and motor assembly into said well casing; and
(e) pumping said fluid out of the well casing in the annular space between the electrical wire and the flexible tubing.

BRIEF DESCRIPTION OF THE DRAWINGS

FIG. 1 is a side, cross-sectional view, in partially schematic form, illustrating a well pumping system in accordance with the invention.

FIG. 2 is a partial side view illustrating in greater detail the downhole pump and motor assembly in accordance with the invention.

FIG. 3 is a cross-sectional view taken along line 3—3 of FIG. 1.

DETAILED DESCRIPTION OF THE DRAWINGS

Figure 4:
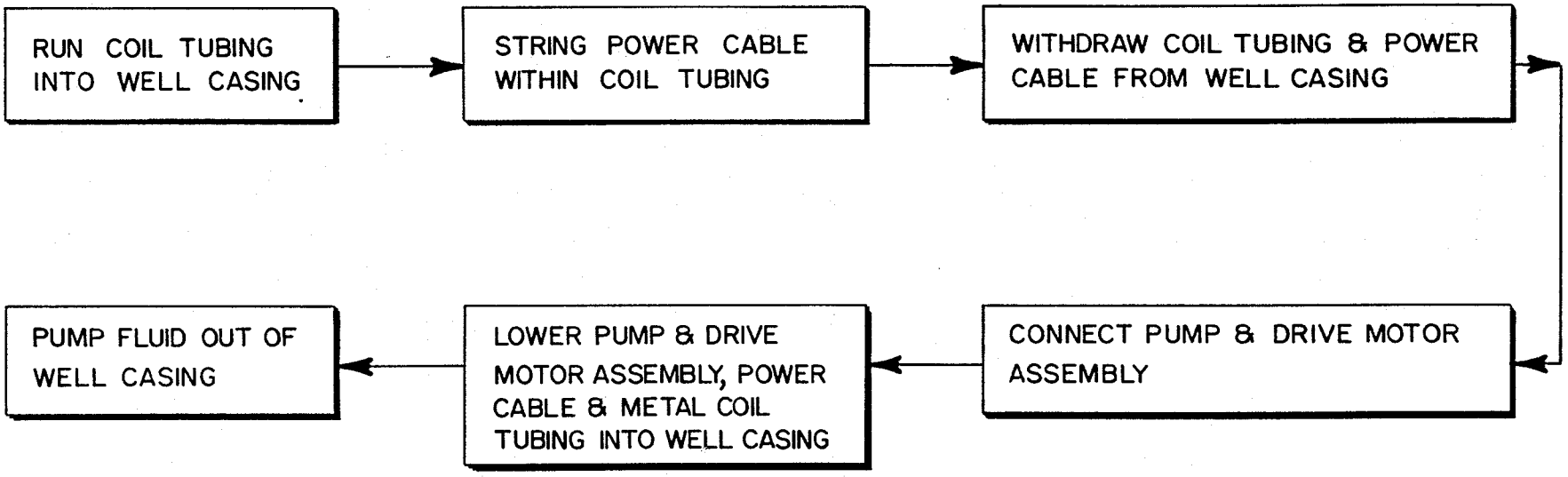
FIG. 4 is a flow diagram illustrating a well pumping process in accordance with the invention.

Referring now to FIG. 1, a well pumping system 10 in accordance with this invention is illustrated in schematic form. A well casing 12, typically cylindrical in shape, is shown extending substantially vertically downward below the ground surface 14. The well depth may be as great as 30,000 feet, but is typically on the order of 4700 feet. Greatest pumping efficiencies are achieved at well depths of up to about 8000 feet. The well casing per se forms no part of this invention and may be of any suitable conventional design. Also, no attempt has been made to show the various components illustrated in FIG. 11 to scale. Rather FIG. 1 is primarily designed to facilitate a clear understanding of the invention.

The lower extremity of the well casing 12 is provided with a plurality of perforations 16 which extend about the periphery of the casing, and through which water, oil, and/or gas are drawn into the casing during pumping.

The upper end of the metal coil tubing is provided with a fluid outlet 18, a wellhead 20, and a stuffing box 22, the details of which are within the ordinary level of skill in the art, noting that the present invention permits these components to be of substantially smaller size than typical prior art installations.

There is suspended from the wellhead a flexible tubular member 24 extending substantially the length of the casing 12. The remote, or downhole, end of member 24 supports a pump and motor assembly 26. Electrical connection between the assembly and an external power source (not shown) is by way of a power cable 28, shielded by the coil tubing 24 and electrically connected to the pump in the usual manner. In this way, the pump and motor assembly are supported solely by the tubular member with no stress applied to the power cable.

The flexible tubular member 24 is preferably conventional metal coil tubing, having an outside diameter of about 1.25 inches, and an inside diameter of about 1.049 inches, although these dimensions may vary, e.g., coil tubing with a 1.0 inch O.D. may be used. The power cable 28 is preferably a #10, 3-wire 600 V wire, clad in a suitable material such as polypropylene or the like, and having an outside diameter of about 0.540 inches. The arrangement of the electrical cable within the metal coil tubing 24 is best seen in FIG. 3, wherein wires 30, 32 and 34 are encased in a polypropylene (or other suitable material) sheath 36. The wire cable 28 and flexible tubing 24 are sized to create a substantially annular space 38 through which the well fluid is pumped.

The above described wire 28 has adequate tensile strength to support its own weight to a depth of about 8000 feet. By incorporating a small diameter solid wire (not shown) in the center of the cable, this length may be extended to 12,000 feet. The clad wire is also oil-, salt water-, and gas-resistant, and will function at temperatures up to about 300 degrees F.

According to this invention, it has been discovered that space 38 is sufficient to pump a volume of oil well fluids which will accommodate approximately 90% of existing wells that are less than 6000 feet deep, and produce less than 100 barrels of total fluid.

With reference now to FIG. 2, the pump and motor assembly 26, shown only schematically in FIG. 1, is shown in greater detail. The assembly includes a conventional union 40 provided with interior electrical terminals (not shown) by which the tubing 24 and cable 28 are connected to the pump and motor assembly 26. A one-inch (1") check valve 42 is utilized to prevent fluid in the coil tubing 24 from draining out during down time, thereby avoiding the possibility of an operator inadvertently turning the pump on while the fluid is draining back into the well, thus damaging the motor shaft.

A polypropylene strainer 44, or other suitable means, serves to filter out particles of over 50 microns in the well fluid where needed. The strainer attaches to a submersible pump 46, which is driven by a submersible motor 48, connected to the pump via spool connection 50.

The submersible motor is preferably a relatively small (1–10 HP) Franklin electric motor especially designed for operation in a submersed environment at an operating temperature of 260 degrees F. at 3400 rpm. The motor housing incorporates a micro-computer which monitors selected parameters such as high-low voltage, high-low amperage and temperature, providing signals to a surface computer which can shut down the system when any one or more of these variables is outside a predetermined range. This, of course, reduces the possibility of motor burnouts in case of loss pump suction, gas locking, downhole short circuiting, and the like.

The pump 46 is preferably a small gear or a piston pump with a diameter of about 2.75 inches. The pump has an intermittent pump pressure maximum of about 3500 psi, and a continuous maximum pressure of about 1500 psi for the gear pump, and 4000 psi for piston pumps. Such pumps are available in sizes ranging from about 0.98 gpm to about 10 gpm. The pump is preferably constructed of suitable corrosion-resistant material such as stainless steel, monel, and other alloys. The service life of the pump will depend on a number of factors, such as operating pressure, corrosiveness of the fluids being pumped, temperature, and sufficient lubrication. The pump life expectancy should be in the range of 10,000 hours in salt water environment, and as much as 25,000 hours in an oil environment.

The operating efficiency of the above described system is about 95% compared to typical prior art efficiencies of about 50% for the pumping unit and 30% for a typical downhole centrifugal pump, depending on depths.

In order to install the presently described system in, for example, an existing 4000 foot well, and with specific reference to FIG. 4, a coil tubing unit 52 is provided, preferably mounted on the bed of a truck 54 or the like. The unit comprises a main storage drum 56 and an idler power drum 58. Initially, coil tubing 24 is unwound from drum 56, passed through guide 57, over drum 58 and run into the well casing to substantially the full depth of the casing. The uppermost end of the tubing is cut off at the wellhead, adjacent outlet 18. Thereafter, the electrical cable 28 is connected at the one end to the coil tubing remaining on drum 56 and wound onto the drum in an appropriate length. The electrical cable 28 is then run to the bottom of the well casing within the coil tubing. A ¾" sinker bar may be applied to the lead end of the electrical cable to facilitate running of the cable through the tubing.

After the power cable is fully inserted within the coil tubing, the composite cable/tubing assembly is withdrawn from the well casing and rewound on the drum 56. Thereafter, the downhole end of the power cable and coil tubing are connected to the motor and pump assembly 26 at the union 40.

Finally, the entire assembly is lowered into position within the well casing, and appropriate electrical and mechanical hookups are made at the wellhead. In this regard, the tubing 24 will extend to the fluid outlet 18 while power cable 28 continues upward through the stuffing box 22 to an appropriate electrical power source (not shown). Pumping may then commence with fluid being drawn into the inlet 60 of the pump, it being understood that the pump outlet (not shown) is connected to the annular space 38 between the tubing 24 and power cable 28. The fluid is pumped into the fluid outlet 18 and into a pipe line of conduit.

As previously indicated, the inherent flexibility of the composite cable and tubing assembly permits the submersible motor and pump assembly within crooked or curved well casings, a feature not possible with conventional, rigid sucker rod strings.

While the invention has been described in connection with what is presently considered to be the most practical and preferred embodiment, it is to be understood that the invention is not to be limited to the disclosed embodiment, but on the contrary, it intended to cover various modifications and equivalent arrangements included within the spirit and scope of the appended claims.

What is claimed is:

1. A method of pumping fluid from the bottom of a well comprising:

(a) locating a submersible pump and motor assembly within a well casing, said assembly suspended in said well casing by an electrical power cable surrounded by hollow, flexible metal coil tubing, said power cable and tubing extending between said assembly and a wellhead; and (b) pumping fluid from the well in a substantially annular space between said electrical cable and said hollow flexible metal coil tubing.

2. A method according to claim 1 wherein said metal coil tubing has an outside diameter of about 1.25 inches and an inside diameter of about 1.049 inches, and wherein said electrical power cable has an outside diameter of about 0.540 inches.

3. A method of pumping fluid from the bottom of a well casing comprising the steps of:

(a) providing hollow, flexible tubing having a length approximately the depth of the well;

(b) inserting an electrical cable within said tubing, said cable and tubing sized to create a substantially annular space between said wire and said tubing;

(c) attaching said electrical wire and said tubing to a submersible motor and pump assembly;

(d) lowering said pump and motor assembly into said well casing; and (e) pumping said fluid out of the well casing in the annular space between the electrical cable, and the flexible tubing.

4. A method according to claim 3 wherein, prior to step (b), said flexible tubing is lowered into said well casing.

5. A method according to claim 4 wherein, prior to step (c) said electrical cable and flexible tubing are withdrawn from said well casing.

6. A method according to claim 3 wherein during the practice of step (c) an outlet of said pump is operatively connected to said hollow flexible tubing.

7. A method according to claim 3 wherein said hollow flexible tubing comprises metal coil tubing.

8. A method according to claim 7 wherein said metal coil tubing has an outside diameter of about 1.25 inches and an inside diameter of about 1.049 inches, and wherein said electrical cable has an outside diameter of about 0.540 inches.

9. A method of installing a pump and associated drive motor assembly in a well casing and pumping fluid out of said well casing comprising the steps of:

(a) running hollow metal coil tubing having an inside diameter into the well to the approximate bottom of the well;

(b) stringing a power cable having an outside diameter less than said tubing inside diameter within said coil tubing to the said approximate bottom of the well;

(c) withdrawing the coil tubing and power cable from the well casing;

(d) connecting said pump and drive motor assembly electrically to the power cable and structurally to the coil tubing;

(e) lowering said pump and drive motor assembly, power cable and metal coil tubing into the well casing to the approximate bottom of the well; and (f) pumping fluid out of said well casing in a substantially annular space between said tubing and said power cable.

10. A method according to claim 9 wherein said coil tubing has an outside diameter of about 1.25 inches, and an inside diameter of about 1.049 inches.

11. A method according to claim 10 wherein said power cable comprises #10, 3-wire conductor wire, having an outside diameter of about 0.540 inches.

12. A method according to claim 9 wherein said motor assembly includes a motor having a HP rating of between about 1 and 10.

13. A method according to claim 11 wherein said power cable is clad in a plastic material.

14. A method according to claim 9 and including the further step of shutting the motor down upon detection of values for selected parameters outside predetermined ranges.

15. A method according to claim 9 wherein said pump comprises a gear pump rated at about 2500 psi maximum intermittent pressure and about 1500 psi maximum continuous pressure.

16. A method according to claim 9 wherein said pump comprises a piston pump rated at about 4000 psi.

17. A well pumping system comprising:

(a) a well casing having upper and lower ends, said upper end connected to a wellhead;

(b) an electrical cable extending between said wellhead and the lower end of said well casing;

(c) metal coil tubing shielding and loosely surrounding said electric cable; and (d) means for pumping fluid out of said well in space between said cable and said tubing;

18. A well pumping system according to claim 17 wherein said motor is rated at about 1 to about 10 HP.

19. A well pumping system according to claim 17 and further including means for monitoring selected downhole parameters and means for shutting down the motor in the event values associated with said parameters are outside predetermined ranges.

20. A well pumping system according to claim 17 wherein said well casing is in the range of about 4000 to about 20,000 feet in length.

21. A well pumping system according to claim 17 wherein said pumping means comprises a gear pump having a diameter of about 2.75 inches.

22. A well pumping system according to claim 17 wherein said tubing has an outside diameter of about 1.25 inches and an inside diameter of about 1.049 inches.

23. A well pumping system according to claim 22 wherein said electric cable has a outside diameter of about 0.540 inches.

24. A well pumping system according to claim 23 wherein said electrical cable comprises a three wire braided cable coated with plastic material.

25. A well pumping system as defined in claim 17 wherein said pump has an outlet, said outlet connected to said metal oil tubing.

26. A well pumping system as defined in claim 17 and further including drum means for running said tubing and power cable into and out of said well ring.

27. A method of pumping fluid from the bottom of a well comprising:

(a) locating a submersible pump and motor assembly within a well casing, said assembly suspended in said well casing by an electrical power cable surrounded by hollow, flexible tubing, said power cable and tubing extending between said assembly and a wellhead; and (b) pumping fluid from the well in a substantially annular space defined by said electrical cable and said hollow flexible tubing.

28. A method according to claim 27 wherein said hollow flexible tubing comprises metal coil tubing.

29. A method according to claim 28 wherein said metal coil tubing has an outside diameter of about 1.25 inches and an inside diameter of about 1.049 inches, and wherein said electrical power cable has an outside diameter of about 0.540 inches.

* * * * *